US009169813B2

(12) United States Patent
Adachi

(10) Patent No.: US 9,169,813 B2
(45) Date of Patent: Oct. 27, 2015

(54) FUEL INJECTION VALVE

(71) Applicant: DENSO CORPORATION, Kariya, Aichi-pref. (JP)

(72) Inventor: Naofumi Adachi, Takahama (JP)

(73) Assignee: DENSO CORPORATION, Kariya (JP)

( * ) Notice: Subject to any disclaimer, the term of this patent is extended or adjusted under 35 U.S.C. 154(b) by 218 days.

(21) Appl. No.: 14/055,352

(22) Filed: Oct. 16, 2013

(65) Prior Publication Data

US 2014/0131483 A1 May 15, 2014

(30) Foreign Application Priority Data

Nov. 13, 2012 (JP) ..... 2012-249581

(51) Int. Cl.
*F02M 47/02* (2006.01)
*F02M 55/00* (2006.01)

(52) U.S. Cl.
CPC ..... *F02M 47/027* (2013.01); *F02M 2547/00* (2013.01); *F02M 2547/008* (2013.01)

(58) Field of Classification Search
CPC ... F02M 47/02; F02M 47/022; F02M 47/025; F02M 47/027; F02M 55/002; F02M 55/008; F02M 2547/00; F02M 2547/008
See application file for complete search history.

(56) References Cited

U.S. PATENT DOCUMENTS

| | | | | |
|---|---|---|---|---|
| 2003/0111547 | A1* | 6/2003 | Ricco | 239/88 |
| 2004/0195348 | A1* | 10/2004 | Lewis et al. | 239/88 |
| 2010/0301143 | A1 | 12/2010 | Adachi et al. | |
| 2011/0198418 | A1 | 8/2011 | Kobane et al. | |
| 2011/0240768 | A1* | 10/2011 | Fujikake et al. | 239/533.2 |
| 2012/0012680 | A1* | 1/2012 | Adachi et al. | 239/533.2 |
| 2012/0042852 | A1* | 2/2012 | Yamada et al. | 123/445 |
| 2012/0103308 | A1* | 5/2012 | Hefler et al. | 123/447 |
| 2012/0111965 | A1* | 5/2012 | Ibrahim et al. | 239/5 |
| 2012/0152206 | A1* | 6/2012 | Adachi et al. | 123/445 |

FOREIGN PATENT DOCUMENTS

| | | |
|---|---|---|
| JP | 2006-322430 | 11/2006 |
| JP | 2007-205263 | 8/2007 |
| JP | 2011-169241 | 9/2011 |
| JP | 2011-169242 | 9/2011 |

* cited by examiner

*Primary Examiner* — Darren W Gorman
(74) *Attorney, Agent, or Firm* — Nixon & Vanderhye P.C.

(57) ABSTRACT

A movable plate is movably accommodated in a pressure control chamber. A fixed plate is arranged above the movable plate, so that the movable plate is brought into contact with the fixed plate. The fixed plate has a high pressure passage for supplying fuel into the pressure control chamber and a low pressure passage for discharging the fuel from the pressure control chamber. A high pressure port and a low pressure port are formed at a lower end surface of the fixed plate. A first contacting surface is formed at the lower end surface and a first groove is formed in the first contacting surface for holding a part of fuel in a plate-contacted condition.

10 Claims, 12 Drawing Sheets

DRIVE CURRENT
0

CONTROL VALVE
OPEN
CLOSE

CONTROL-CHAMBER PRESSURE
HIGH
LOW

MOVABLE PLATE
CLOSE
OPEN

NEEDLE
OPEN
CLOSE

INJECTION RATE
0
t1
t2
t3
t4
t5
t6
TIME

FUEL INJECTION VALVE

CROSS REFERENCE TO RELATED APPLICATION

This application is based on Japanese Patent Application No. 2012-249581 filed on Nov. 13, 2012 the disclosure of which is incorporated herein by reference.

FIELD OF TECHNOLOGY

The present disclosure relates to a fuel injection valve for injecting fuel into an internal combustion engine.

BACKGROUND

A fuel injection valve is known in the art, for example, as disclosed in the following Japanese Patent publications:
Japanese Patent Publication No. 2011-169241
Japanese Patent Publication No. 2011-169242
Japanese Patent Publication No. 2011-012670

According to the fuel injection valve disclosed in any of the above prior arts, fuel pressure in a pressure control chamber (that is, back pressure of a valve body) is controlled so that the valve body is operated to open or close an injection port. In other words, the back pressure biases the valve body in a valve closing direction. When the fuel is discharged from the pressure control chamber to decrease the back pressure, the valve body is moved in a valve opening direction. On the other hand, when the fuel is supplied into the pressure control chamber to increase the back pressure, the valve body is moved in the valve closing direction. A structure for the above operation is formed by a fixed plate 20 and a movable plate 80 shown in FIG. 12 attached to the present application.

In FIG. 12, a high pressure passage 22 for supplying high pressure fuel into a pressure control chamber 71 and a low pressure passage 23 for discharging the fuel from the pressure control chamber 71 are formed in the fixed plate 20. In addition, the fixed plate 20 has contacting surfaces 25*s* and 26*s* at its lower end surface, in which a high pressure port 22*b* (corresponding to an outlet port of the high pressure passage 22) and a low pressure port 23*c* (corresponding to an inlet port of the low pressure passage 23) are respectively formed. The movable plate 80 is brought into contact with the contacting surfaces 25*s* and 26*s* in order to close the high pressure port 22*b* when discharging the fuel from the pressure control chamber 71. The movable plate 80 is separated from the contacting surfaces 25*s* and 26*s* in order to open the high pressure port 22*b* when supplying the high pressure fuel into the pressure control chamber 71.

The inventor of the present disclosure has found out that a linking force is generated between the fixed plate 20 and the movable plate 80 in the above structure of the prior art shown in FIG. 12, when the movable plate 80 is going to be separated from the fixed plate 20. The linking force is generated due to a fact that the fuel does not easily flow from the high pressure passage 22 and/or the low pressure passage 23 into spaces between the contacting surfaces 25*s* and 26*s* of the fixed plate 20 and the movable plate 80.

When the linking force is generated, the movable plate 80 cannot be smoothly and rapidly separated from the fixed plate 20. Then, timing for opening the high pressure port 22*b* may be delayed and thereby a response for increasing the back pressure and moving the valve body in the valve closing direction may go down. In such a case, a valve opening time period may become longer than intended. It may cause a problem that a fuel injection amount becomes larger than a supposed value.

In addition, since the linking force is unstable, it may cause variation for the timing of opening the high pressure port 22*b*. As a result, it may cause variation for the fuel injection amount.

The movable plate 80 is strongly pushed to the contacting surfaces 25*s* and 26*s*, when the movable plate 80 is in contact with the fixed plate 20. Therefore, when areas of the contacting surfaces 25*s* and 26*s* are simply made smaller in order to reduce the linking force, the contacting surfaces 25*s* and 26*s* may be worn away in an unusual manner.

SUMMARY OF THE DISCLOSURE

The present disclosure is made in view of the above problem. It is an object of the present disclosure to provide a fuel injection valve, according to which a movable plate can be smoothly separated from a fixed plate.

According to a feature of the present disclosure, a fuel injection valve has a valve body, a fixed plate and a movable plate. The valve body opens or closes an injection port for injecting fuel and is arranged in the fuel injection valve in such a way that fuel pressure of a pressure control chamber is applied to the valve body in a valve-body closing direction. The fixed plate has a high pressure passage for supplying high pressure fuel into the pressure control chamber in order to move the valve body in the valve-body closing direction and a low pressure passage for discharging the fuel from the pressure control chamber in order to move the valve body in a valve-body opening direction. In addition, the fixed plate has contacting surfaces in which a high pressure port and a low pressure port are formed, wherein the high pressure port corresponds to an outlet port of the high pressure passage and the low pressure port corresponds to an inlet port of the low pressure passage. The movable plate is brought into contact with the contacting surfaces so as to close the high pressure port when discharging the fuel from the pressure control chamber, while the movable plate is separated from the contacting surfaces so as to open the high pressure port when supplying the high pressure fuel into the pressure control chamber.

A first groove is formed at a first contacting surface among the contacting surfaces of the fixed plate and/or a first sealing surface of the movable plate, wherein the first contacting surface separates the high pressure port from the low pressure port and the first sealing surface is a portion of an upper end surface of the movable plate being in contact with the first contacting surface in a plate-contacted condition. The first groove holds therein the fuel in the plate-contacted condition.

According to the above feature of the present disclosure, the fuel flows into spaces between the first contacting surface and the first sealing surface from the high pressure port and the low pressure port (as indicated by arrows A and B in FIG. 6), when the movable plate is going to be separated from the fixed plate from the plate-contacted condition (in which the first contacting surface and the first sealing surface are strongly in contact with each other). In addition, the fuel flows into the above spaces from the first groove (as indicated by arrows C and D in FIG. 6). As a result, the linking force generated between the fixed plate and the movable plate can be reduced.

It is, therefore, possible to avoid a situation that timing of the movable plate separating from the fixed plate is delayed due to the linking force and thereby timing for opening the high pressure port is delayed. As a result, it is possible to prevent response for increasing the control pressure in the pressure control chamber (the back pressure) and moving the valve body in the valve closing direction from getting down.

Since the linking force can be reduced, variation for the timing of opening the high pressure port can be made smaller. In other words, variation for the timing of increasing the back pressure and moving the valve body in the valve closing direction can be made smaller. Variation for the fuel injection amount can be finally made smaller.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
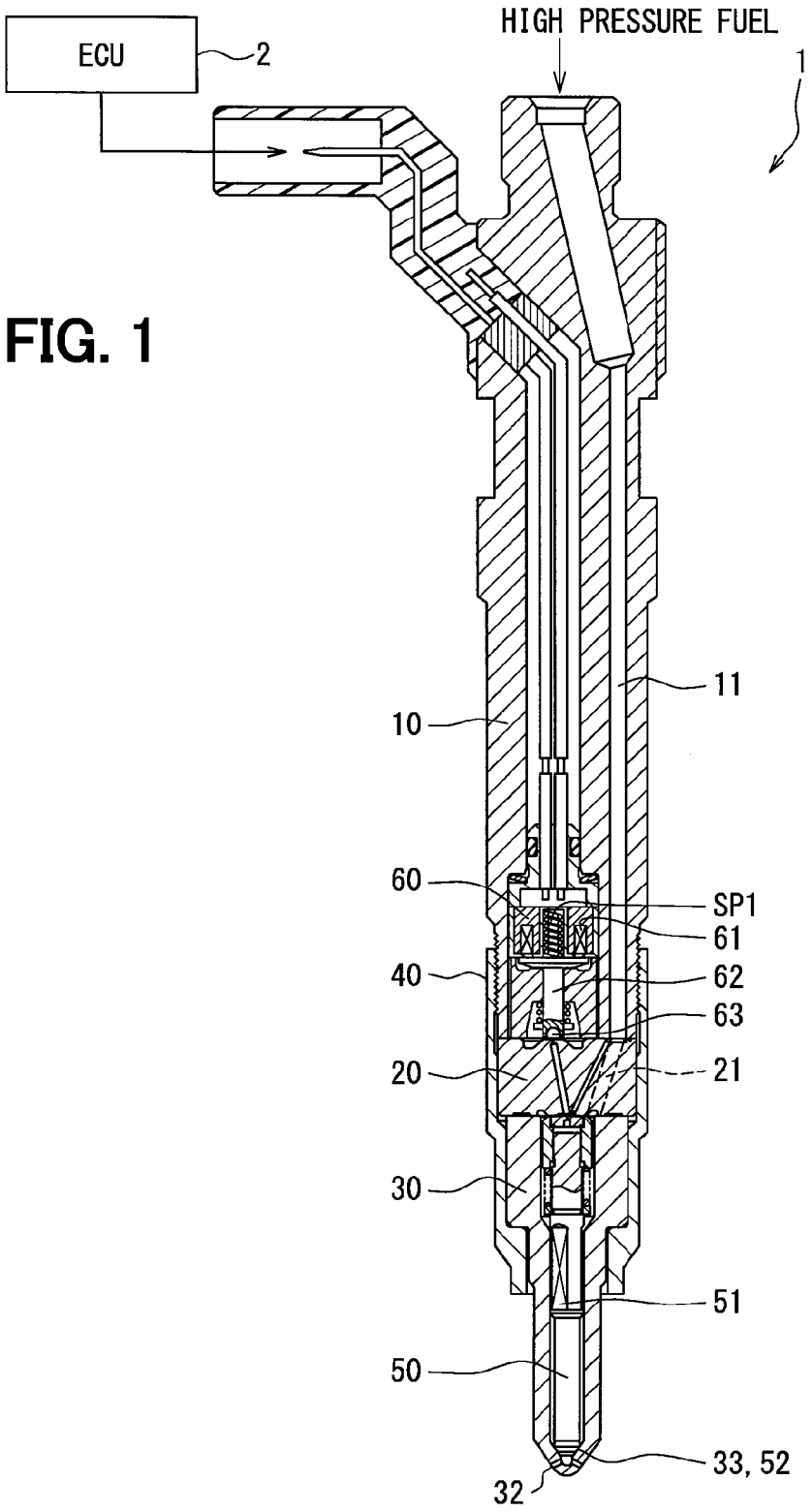
FIG. 1 is a schematic cross sectional view showing a fuel injection valve according to a first embodiment of the present disclosure.

The present disclosure will be explained hereinafter by way of multiple embodiments, in which a fuel injection valve is applied to an internal combustion engine (hereinafter, an engine) mounted in a vehicle. The engine in each of the embodiments is, for example, a compression-ignition type engine, such as a diesel engine. The same reference numerals are given to the same or similar portions and/or structures throughout the embodiments, for the purpose of eliminating repeated explanation.

First Embodiment

A fuel injection valve 1 shown in FIG. 1 is operated by a drive current outputted from an electronic control unit 2 (hereinafter, the ECU 2). The ECU 2 calculates a target injection amount based on engine load, engine rotational speed and so on. The ECU 2 calculates an injection time period, which corresponds to the target injection amount, depending on pressure of high pressure fuel to be supplied to the fuel injection valve 1. The ECU 2 calculates a power-supply time period depending on the above calculated injection time period, wherein a delay time for starting fuel injection as well as a delay time for terminating the fuel injection is taken into consideration. Then, the drive current is supplied to the fuel injection valve 1 during the power-supply time period.

The fuel injection valve 1 is composed of a holder 10 made of metal, a fixed plate 20 and a nozzle body 30, wherein the fixed plate 20 and the nozzle body 30 are assembled to the holder 10 by a retaining nut 40. Hereinafter, the holder 10, the fixed plate 20 and the nozzle body 30 are collectively referred to as an injection body.

A needle 50 (a valve body) is movably accommodated in the nozzle body 30. Injection ports 32 are formed at a forward end of the nozzle body 30 in order to inject high pressure fuel. When a valve body surface 52 formed in the valve body 50 is separated from a valve seat surface 33 formed in the nozzle body 30, the injection ports 32 are opened so as to inject the fuel. On the other hand, when the valve body 50 is seated on the valve seat surface 33, the injection ports 32 are closed so as to terminate the fuel injection.

High pressure fluid paths 11, 21, 31 and 51 are formed in the injection body (10, 20, 30) in order to introduce the high pressure fuel to the injection ports 32. The high pressure fuel is supplied to the fuel injection valve 1 from an outside component (not shown), that is, a common rail (a pressure accumulating device). The high pressure fluid paths 11, 21, 31 and 51 are formed in each of the holder 10, the fixed plate 20 and the nozzle body 30. The high pressure fluid path 51 is a fluid path formed between the nozzle body 30 and the valve body 50.

Figures 7A, 7B, 7C, 7D, 7E, 7F:
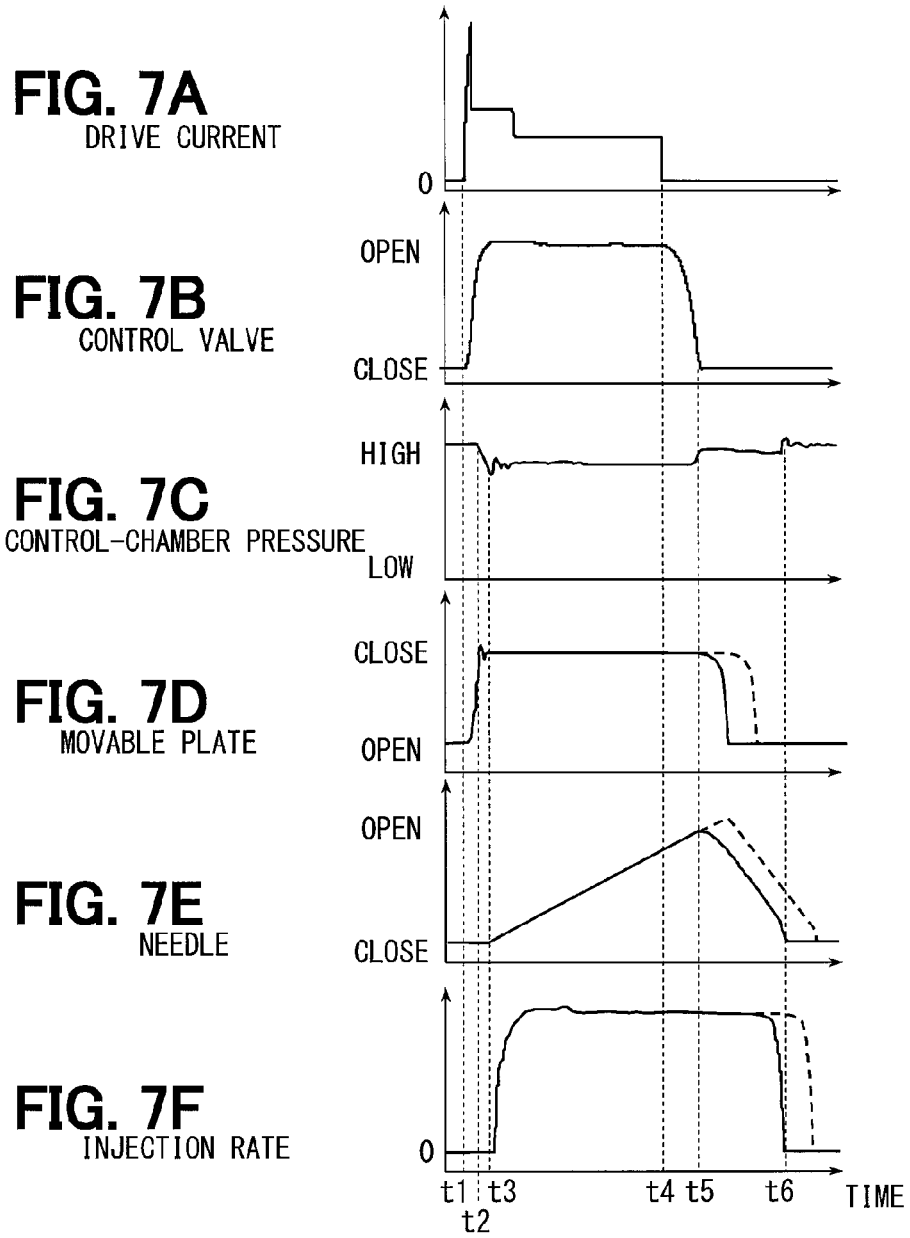
FIGS. 7A to 7F are time charts for explaining operation of the fuel injection valve of the first embodiment.

An electric actuator 60 having a solenoid coil 61 or a piezoelectric element is provided in the holder 10. The electric actuator 60 shown in FIG. 1 has the solenoid coil 61, a piston 62, a control valve 63 and a spring SP1. When the drive current is supplied to the solenoid coil 61 to generate electromagnetic force, the piston 62 is attracted by the electromagnetic force and the control valve 63 is moved to a control-valve opening position (as shown in FIG. 7A and FIG. 7B). When the power supply to the solenoid coil 61 is cut off, the piston 62 is pushed down by a spring force of the spring SP1 so that the control valve 63 is moved to a control-valve closing position.

Figure 2:
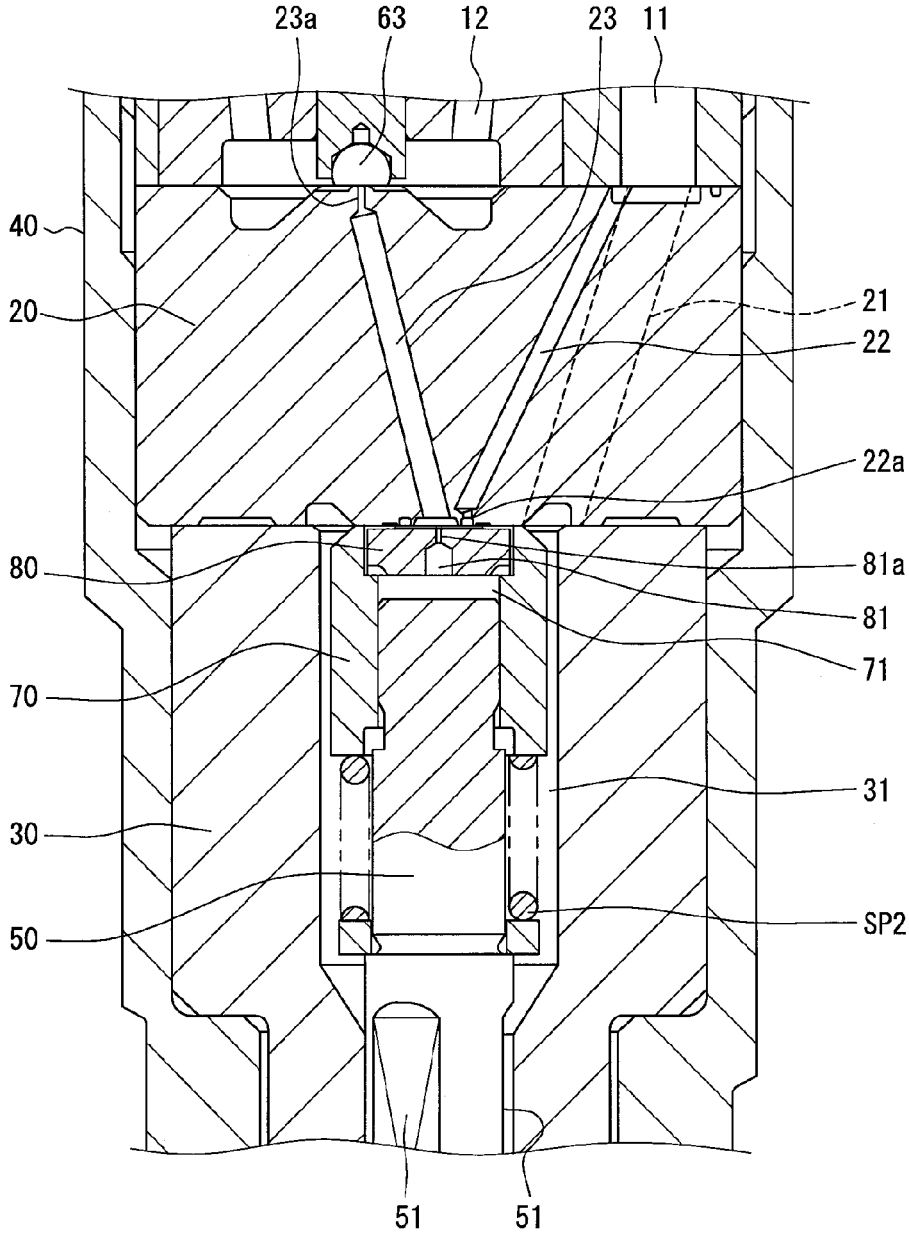
FIG. 2 is a schematically enlarged cross sectional view showing relevant portions of the fuel injection valve of FIG. 1.

As shown in FIG. 2, a cylindrical member 70 is fixed to a lower end surface of the fixed plate 20. An upper end portion of the valve body 50 is movably inserted into the cylindrical member 70, so that the valve body 50 can be moved in an upward direction and in a downward direction. The upward direction is an axial direction of the fuel injection valve 1 toward an opposite side of the injection ports 32, while the downward direction is the axial direction of the fuel injection valve 1 toward the injection ports 32.

A space surrounded by an inner peripheral wall of the cylindrical member 70, the lower end surface of the fixed plate 20 and an upper end surface of the valve body 50 forms a pressure control chamber 71. A high pressure passage 22 for supplying the high pressure fuel into the pressure control chamber 71 and a low pressure passage 23 for discharging the fuel from the pressure control chamber 71 are respectively formed in the fixed plate 20. An orifice 23*a* is formed at a downstream side of the low pressure passage 23. An outlet port of the low pressure passage 23 is opened or closed by the control valve 63. The high pressure passage 22 is bifurcated from the high pressure fluid paths 11 and 21. An orifice 22*a* is formed at a downstream side of the high pressure passage 22.

Figure 3:
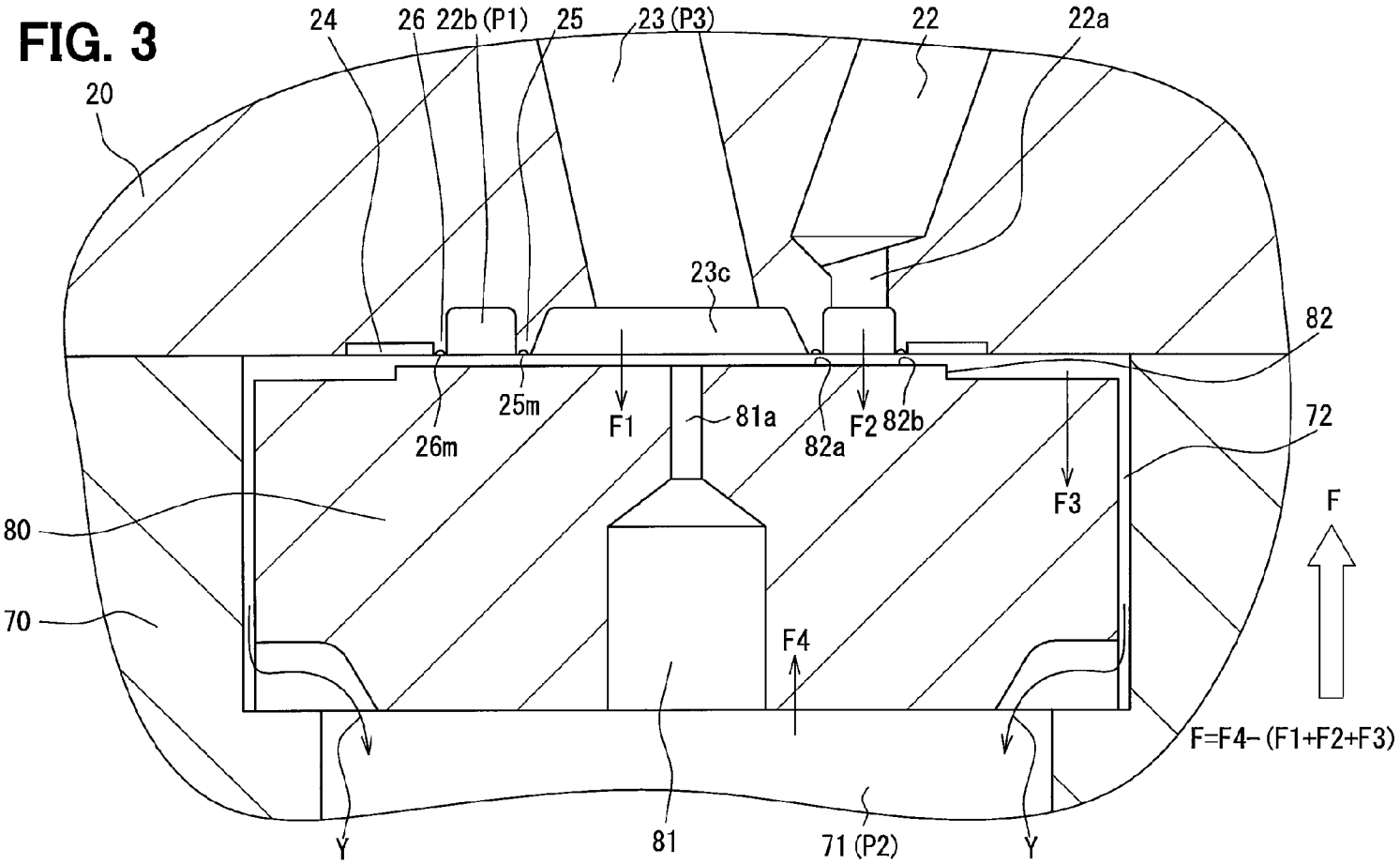
FIG. 3 is a schematically enlarged cross sectional view showing further relevant portions of the fuel injection valve of FIG. 2.

As shown in FIG. 3, a movable plate 80 of a disc shape is movably accommodated in the pressure control chamber 71, so that the movable plate 80 is movable in the upward and downward direction. A projection 82 of a circular shape projecting in the upward direction is formed at an upper end surface of the movable plate 80. When an upper end surface of the projection 82 is brought into contact with the lower end surface of the fixed plate 20, a high pressure port 22*b* (which is an outlet port of the high pressure passage 22) is closed by the projection 82. FIG. 3 shows a condition of the movable plate 80, which is separated from the lower end surface of the fixed plate 20 and thereby the high pressure port 22*b* is opened.

A through-hole 81 is formed in the movable plate 80 in order to communicate a low pressure port 23*c* (which is an inlet port of the low pressure passage 23) and the pressure control chamber 71 with each other. An orifice 81*a* is formed at a downstream side of the through-hole 81 (at an upper side of the movable plate 80). According to the above structure, the pressure control chamber 71 is continuously communicated to the low pressure passage 23, even when the movable plate 80 is brought into contact with the fixed plate 20 to close the high pressure port 22*b*.

Figure 4:
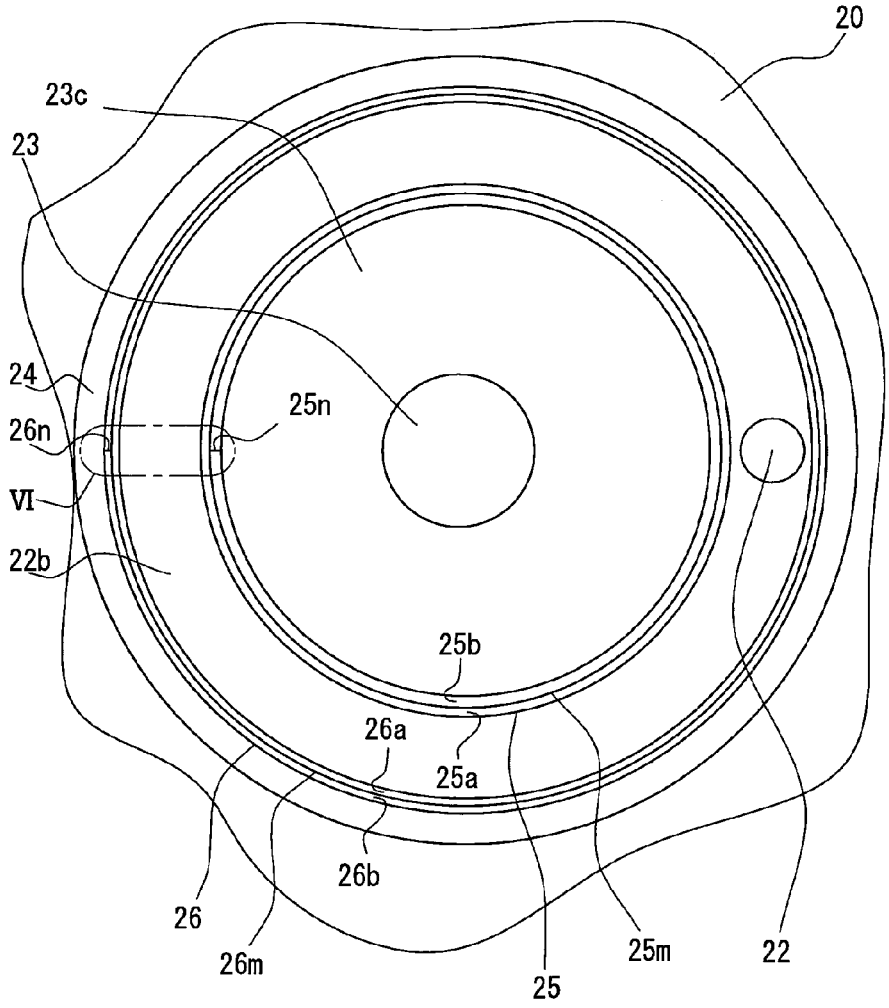
FIG. 4 is a schematic bottom view of a fixed plate of FIG. 3, when viewed from an injection port side.

As shown in FIG. 4, the low pressure port 23*c* is formed in a circular shape at a center of the lower end surface of the fixed plate 20. The high pressure port 22*b*, which is formed at a downstream side of the orifice 22*a*, is formed in an annular shape at the lower end surface of the fixed plate 20 so as to surround the low pressure port 23*c*. As shown in FIGS. 3 and 4, an annular recessed portion 24 is further formed at the lower end surface of the fixed plate 20 so as to surround the high pressure port 22*b*. A gap 72, which is formed between an outer peripheral wall of the movable plate 80 and an inner peripheral wall of the cylindrical member 70, has a function as a fuel passage so that the high pressure fuel in the high pressure passage 22 flows into the pressure control chamber 71 through the gap 72. When the movable plate 80 moves in the downward direction to open the high pressure port 22*b*, the high pressure fuel flows from the high pressure passage 22 into the pressure control chamber 71 through the annular recessed portion 24 and the gap 72, as indicated by arrows Y in FIG. 3.

Figure 5:
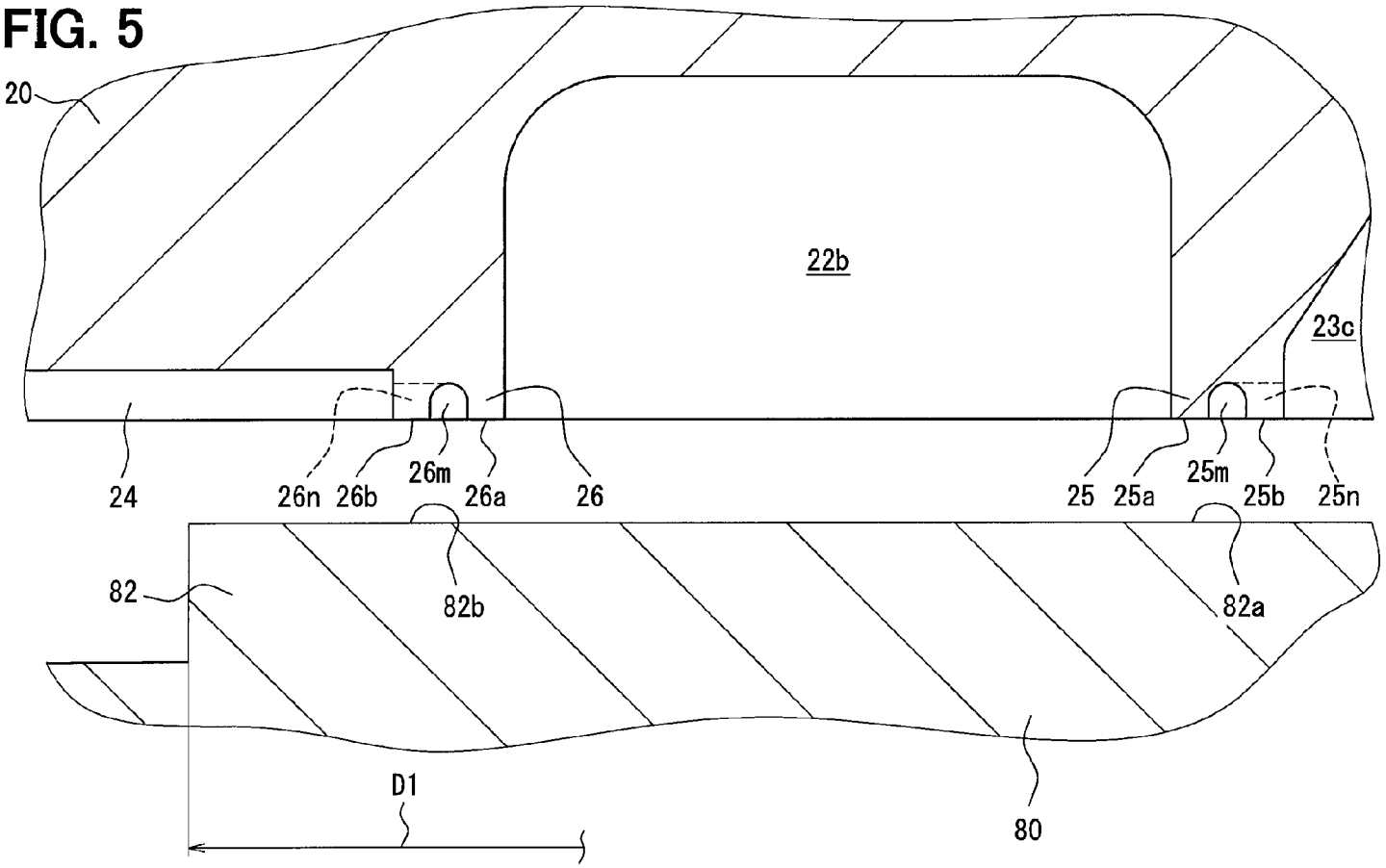
FIG. 5 is a schematically enlarged cross sectional view showing relevant portions of the fuel injection valve of FIG. 3.

As shown in FIG. 5, a portion of the lower end surface of the fixed plate 20 (a contact surface) for partitioning the high pressure port 22*b* from the low pressure port 23*c* is referred to as a first wall portion 25. Another portion of the lower end surface of the fixed plate 20 for partitioning the annular recessed portion 24 from the high pressure port 22*b* is referred to as a second wall portion 26. As shown in FIG. 4, each of the first and second wall portions 25 and 26 extends in an annular form along the high pressure port 22*b*. Lower end surfaces of the first wall portion 25 are referred to as first contacting surfaces 25*a* and 25*b*, while lower end surfaces of the second wall portion 26 are referred to as second contacting surfaces 26*a* and 26*b*. The first and second contacting surfaces 25*a*, 25*b*, 26*a* and 26*b* among the lower end surfaces of the fixed plate 20 are brought into contact with the upper end surface of the movable plate 80. In other words, pushing force to the fixed plate 20 by the movable plate 80 is received by the first and second contacting surfaces 25*a*, 25*b*, 26*a* and 26*b*.

An outer diameter D1 of the projection 82 is made larger than an outer diameter of the second wall portion 26, so that an outer peripheral portion of the projection 82 is located within an area of the annular recessed portion 24 even when the movable plate 80 is displaced within the gap 72 in a radial direction of the fuel injection valve 1 (in a horizontal direction in FIG. 5).

Figure 6:
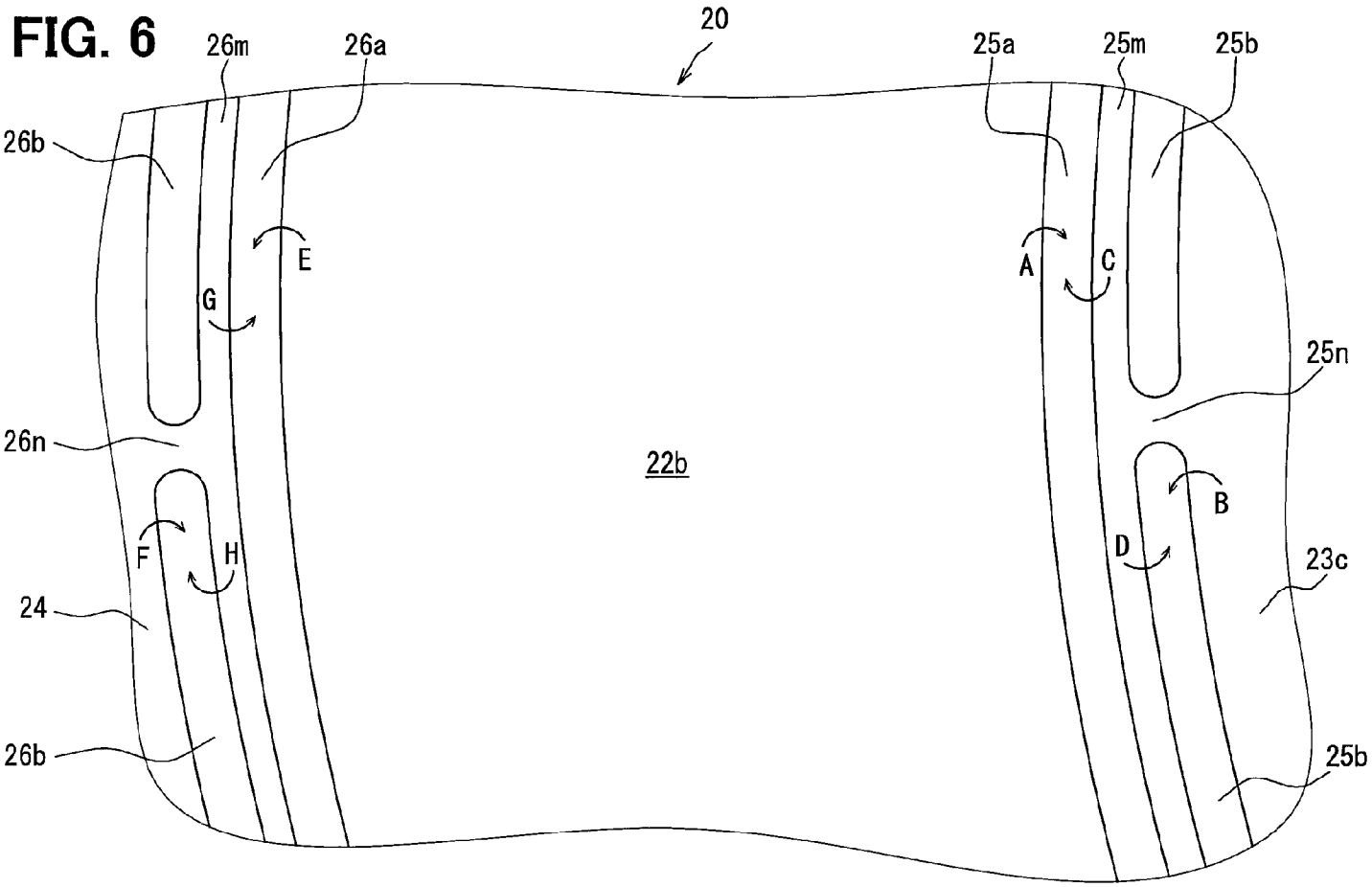
FIG. 6 is a schematically enlarged bottom view showing a relevant portion of the fixed plate indicated by a one-dot-chain line VI in FIG. 4.

As shown in FIGS. 5 and 6, a first annular groove 25*m* is formed at the lower end surface of the first wall portion 25, wherein the first annular groove 25*m* is recessed in a direction away from the movable plate 80. In a similar manner, a second annular groove 26*m* is formed at the lower end surface of the second wall portion 26, wherein the second annular groove 26*m* is recessed in the direction away from the movable plate 80. As shown in FIG. 4, each of the first and second annular grooves 25*m* and 26*m* respectively extends in an annular form along the first and second wall portions 25 and 26. As above, the lower end surface of the first wall portion 25 is divided by the first annular grove 25*m* into two contacting surfaces, that is, the first contacting surface 25*a* on a side closer to the high pressure port 22*b* and the other first contacting surface 25*b* on a side closer to the low pressure port 23*c*. In a similar manner, the lower end surface of the second wall portion 26 is divided by the second annular groove 26*m* into two contacting surfaces, that is, the second contacting surface 26*a* on a side closer to the high pressure port 22*b* and the other second contacting surface 26*b* on a side closer to the annular recessed portion 24.

A portion of the upper end surface of the movable plate 80, which is brought into contact with the first contacting surfaces 25*a* and 25*b* so as to seal such contacting portions, is referred to as a first sealing surface 82*a*. Another portion of the upper end surface of the movable plate 80, which is brought into contact with the second contacting surfaces 26*a* and 26*b* so as to seal such contacting portions, is referred to as a second sealing surface 82*b*.

As shown in FIGS. 5 and 6, a first communication groove 25*n* is formed at the lower end surface of the first wall portion 25 (that is, the first contacting surface 25*b*), so that the first annular groove 25*m* and the low pressure passage 23*c* are communicated to each other. In a similar manner, a second communication groove 26*n* is formed at the lower end surface of the second wall portion 26 (that is, the second contacting surface 26*b*), so that the second annular groove 26*m* and the annular recessed portion 24 are communicated to each other. Accordingly, each of the first contacting surface 25*a* and the second contacting surface 26*a*, both of which are formed on the sides closer to the high pressure port 22*b*, is formed as a complete annular shape extending along the high pressure port 22*b*. On the other hand, each of the first contacting surface 25*b* and the second contacting surface 26*b*, which are formed at the sides opposite to the high pressure port 22*b*, is divided by the first and the second communication grooves 25*n* and 26*n*.

According to the above structure, only the first contacting surface 25*a*, at which the first communication groove 25*n* is not formed, brings out the sealing function among the lower end surfaces of the first wall portion 25, while the first contacting surface 25*b* on the opposite side to the high pressure port 22*b* does not have the sealing function. In a similar manner, only the second contacting surface 26*a*, at which the second communication groove 26*n* is not formed, brings out the sealing function among the lower end surfaces of the second wall portion 26, while the second contacting surface 26*b* on the opposite side to the high pressure port 22*b* does not have the sealing function.

As above, in a condition (a plate-contacted condition) that the movable plate 80 is in contact with the fixed plate 20, that is, a condition that the first and second sealing surfaces 82*a* and 82*b* are in contact with the contacting surfaces 25*a*, 25*b*, 26*a* and 26*b*, the high pressure port 22*b* is closed by the first and second contacting surfaces 25*a* and 26*a*. In the above condition, the first communication groove 25*n* and the first annular groove 25*m* are filled with the low pressure fuel of the low pressure port 23*c*, while the second communication groove 26*n* and the second annular groove 26*m* are filled with fuel of the annular recessed portion 24, in which the fuel of control pressure is filled.

In FIG. 3, "P1" is a pressure in the high pressure passage 22, "P2" is a pressure in the pressure control chamber 71 and "P3" is a pressure in the low pressure passage 23, wherein "P1">"P2">"P3".

In addition, in FIG. 3, "F1" is a force, which the upper end surface of the movable plate 80 receives by the pressure "P3" of the low pressure port 23*c* in the plate-contacted condition (in which the movable plate 80 is in contact with the fixed plate 20). "F2" is a force, which the upper end surface of the movable plate 80 receives by the pressure "P1" of the high pressure port 22*b* in the plate-contacted condition. "F3" is a force, which the upper end surface of the movable plate 80 (the outer peripheral end surface of the movable plate 80 outside of the second wall portion 26) receives by the pressure "P2" of the pressure control chamber 71. "F4" is a force, which the lower end surface of the movable plate 80 receives by the pressure "P2" of the pressure control chamber 71.

Therefore, when a total force of "F1", "F2" and "F3" in the plate-contacted condition is smaller than the force "F4", a force "F" of the upward direction is applied to the movable plate 80, so that the plate-contacted condition is maintained. On the other hand, when the total force of "F1", "F2" and "F3" becomes larger than a force of "F4+Flink", that is, (F1+F2+F3)>(F4+Flink), the movable plate 80 is separated from the fixed plate 20. "Flink" is a linking force generated between the first contacting surfaces 25*a* and 25*b* and the first sealing surface 82*a* and between the second contacting surfaces 26*a* and 26*b* and the second sealing surface 82*b*.

Namely, in the plate-contacted condition (in which the movable plate 80 is in contact with the fixed plate 20 and the valve body 50 opens the injection ports 32), when the control valve 63 is closed and thereby the control pressure "P2" and the low pressure "P3" are increased, the total force of "F1+F2+F3" becomes larger than the force of "F4+Flink". Then, the movable plate 80 is separated from the fixed plate 20. The fuel of the high pressure "P1" flows from the high pressure port 22*b* into the pressure control chamber 71 through the gap 72. The control pressure "P2" in the pressure control chamber 71 is thereby rapidly increased. As a result, the valve body 50 is pushed by the control pressure "P2" to the valve seat surface 33 to close the injection ports 32 (the valve body 50 is moved to its valve-body closing condition).

An operation of the fuel injection depending on the drive current to the fuel injection valve 1 from the ECU 2 will be explained with reference to FIGS. 7A to 7F.

When the drive current is supplied from the ECU 2 to the solenoid coil 61 at a timing "t1" in order to open the control valve 63, the low pressure passage 23 is communicated to a low pressure fluid path 12 (FIG. 2) so that the fuel in the pressure control chamber 71 starts its fuel discharge to an outside of the fuel injection valve 1 via the low pressure passage 23 and the low pressure fluid path 12. The fuel discharge decreases the fuel pressure in a space between the upper end surface of the movable plate 80 and the lower end surface of the fixed plate 20 (that is, the fuel pressure at the low pressure port 23*c*). The movable plate 80 starts its upward movement depending on the decrease of the fuel pressure and the movable plate 80 is brought into contact with the fixed plate 20 at a timing "t2". Namely, the movable plate 80 closes the high pressure port 22*b* to thereby block off the communication between the high pressure passage 22 and the pressure control chamber 71.

Then, the fuel pressure in the pressure control chamber 71 is rapidly decreased, so that the valve body 50 is lifted up at a high speed in a direction toward the pressure control chamber 71. In other words, the valve body 50 starts its upward movement (the displacement) at a timing "t3". During a period ("t3"-"t5") in which the valve body 50 is displaced, the fuel pressure in the pressure control chamber 71 is maintained at almost a constant value, because of a volume reduction of the pressure control chamber 71.

When the power supply of the drive current is thereafter cut off by the ECU 2 in order to start a control-valve closing movement of the control valve 63 at a timing "t4", the fuel discharge through the low pressure passage 23 is terminated. The termination of the fuel discharge increases at first the fuel pressure in the space between the upper end surface of the movable plate 80 and the lower end surface of the fixed plate 20 (that is, the fuel pressure in the low pressure port 23*c*). The force "F1" is thereby increased so that the total force "F1+F2+F3" for pushing down the movable plate 80 is increased.

As a result, the total force "F1+F2+F3" becomes larger than the force "F4+Flink", that is, (F1+F2+F3)>(F4+Flink) the movable plate 80 which has been in the plate-contacted condition is separated from the fixed plate 20 at a timing "t5". More exactly, the movable plate 80 opens the high pressure port 22*b* to thereby communicate the high pressure passage 22 to the pressure control chamber 71. Then, the fuel pressure in the pressure control chamber 71 is rapidly increased to push down the valve body 50 at a high speed. The valve body 50 is seated on the valve seat surface 33 at a timing "t6", which corresponds to the valve-body closing condition.

According to the present embodiment, the first annular groove 25*m* is formed at the lower end surface of the first wall portion 25, wherein the first wall portion 25 separates the high pressure port 22*b* and the low pressure port 23*c* from each other and the first annular groove 25*m* holds the fuel together with the movable plate 80 being in contact with the fixed plate 20. Therefore, the linking force "Flink" can be reduced when the first sealing surface 82*a* of the movable plate 80 is going to be separated from the lower end surface of the first wall portion 25 (that is, the first contacting surfaces 25*a* and 25*b*). More exactly, the fuel flows from the high pressure port 22*b* into a space between the first sealing surface 82*a* and the first contacting surface 25*a*, as indicated by an arrow A in FIG. 6. In a similar manner, the fuel flows from the low pressure port 23*c* into a space between the first sealing surface 82*a* and the other first contacting surface 25*b*, as indicated by an arrow B in FIG. 6. In addition, the fuel flows from the first annular groove 25*m* into the respective spaces, as indicated by arrows C and D in FIG. 6. As a result, the linking force generated between the movable plate 80 and the fixed plate 20 is reduced.

Furthermore, according to the present embodiment, the second annular groove 26*m* is formed at the lower end surface of the second wall portion 26, wherein the second wall portion 26 separates the high pressure port 22*b* and the annular recessed portion 24 from each other and the second annular groove 26*m* holds the fuel together with the movable plate 80 being in contact with the fixed plate 20. Therefore, the linking force can be reduced when the second sealing surface 82*b* of the movable plate 80 is going to be separated from the lower end surface of the second wall portion 26 (that is, the second contacting surfaces 26*a* and 26*b*). More exactly, the fuel flows from the high pressure port 22*b* into a space between the second sealing surface 82*b* and the second contacting surface

26*a*, as indicated by an arrow E in FIG. 6. In a similar manner, the fuel flows from the annular recessed portion 24 into a space between the second sealing surface 82*b* and the other second contacting surface 26*b*, as indicated by an arrow F in FIG. 6. In addition, the fuel flows from the second annular groove 26*m* into the respective spaces, as indicated by arrows G and H in FIG. 6. As a result, the linking force generated between the movable plate 80 and the fixed plate 20 is reduced.

As above, it is possible to prevent the timing (the timing "t5" in FIG. 7D) of the movement of the movable plate 80 (that is, the movable plate 80 is going to be separated from the fixed plate 20 in order to open the high pressure port 22*b*) from being delayed due to the linking force. In other words, it is possible to prevent the performance of the valve body 50 (that is, a response of the valve body 50 moving to its valve-body closing position by the increase of the fuel pressure in the pressure control chamber 71) from getting worse. Accordingly, it is possible to prevent the fuel injection period from getting longer with respect to the power supply period. Namely, it is possible to prevent an actual fuel injection amount from becoming larger than a target amount.

In addition, since the linking force can be reduced as above, it is possible to suppress generation of variation relating to timings for opening the high pressure port 22*b*. It is, therefore, possible to suppress generation of variation relating to timing for closing the valve body 50 by increasing the back pressure of the valve body 50. Variation of the fuel injection amount can be made smaller.

The present embodiment has the following advantages in relation to the following respective features:

(1) First Feature and Advantage:

According to the present embodiment, the first communication groove 25*n* is formed at the first contacting surface 25*b* in order to communicate the first annular groove 25*m* with the low pressure port 23*c* in the plate-contacted condition (in which the movable plate 80 is in contact with the fixed plate 20).

When the movable plate 80 is separated from the fixed plate 20, the fuel flows from the first annular groove 25*m* into the spaces between the first contacting surfaces 25*a* and 25*b* and the first sealing surface 82*a*. In the above operation, the fuel flows from the low pressure port 23*c* to the first annular groove 25*m* through the first communication groove 25*n*. It is, therefore, possible to avoid a situation that negative pressure is generated in the first communication groove 25*n* at a moment when the movable plate 80 is going to be separated from the fixed plate 20. It is, thereby, possible to facilitate that the fuel flows into the spaces between the first contacting surfaces 25*a* and 25*b* and the first sealing surface 82*a*. Thus, the linking force can be further reduced.

In addition, according to the present embodiment, the second communication groove 26*n* is formed at the second contacting surface 26*b* in order to communicate the second annular groove 26*m* with the annular recessed portion 24 in the plate-contacted condition.

When the movable plate 80 is separated from the fixed plate 20, the fuel flows from the second annular groove 26*m* into the spaces between the second contacting surfaces 26*a* and 26*b* and the second sealing surface 82*b*. In the above operation, the fuel flows from the annular recessed portion 24 to the second annular groove 26*m* through the second communication groove 26*n*. It is, therefore, possible to avoid a situation that negative pressure is generated in the second communication groove 26*n* at the moment when the movable plate 80 is going to be separated from the fixed plate 20. It is, thereby, possible to facilitate that the fuel flows into the spaces between the second contacting surfaces 26*a* and 26*b* and the second sealing surface 82*b*. Thus, the linking force can be further reduced.

(2) Second Feature and Advantage:

According to the present embodiment, the first communication groove 25*n* communicates the first annular groove 25*m* to the low pressure port 23*c*, among the high pressure port 22*b* and the low pressure port 23*c*. On the other hand, the second communicating groove 26*n* communicates the second annular groove 26*m* to the annular recessed portion 24, among the high pressure port 22*b* and the annular recessed portion 24.

In a case, contrary to the above feature, the first and second annular grooves 25*m* and 26*m* are communicated to the high pressure port 22*b*, areas of the first and second annular grooves 25*m* and 26*m* also belong to such an area of the movable plate 80, which receives the high pressure "P1" when the high pressure port 22*b* is closed by the movable plate 80. Then, the force "F2" in FIG. 3 is increased. As a result, the pushing force "F=F4−(F1+F2+F3)" of the movable plate 80 to the fixed plate 20 becomes smaller. It may become a problem that certainty for surely closing the high pressure port 22*b* is decreased.

According to the above feature of the present embodiment, however, each of the first and second annular grooves 25*m* and 26*m* is communicated to the respective opposite sides of the high pressure port 22*b* (that is, the low pressure port 23*c* and the annular recessed portion 24). It is, therefore, possible to suppress an increase of the area of the movable plate 80 for receiving the high pressure "P1". Namely, it is possible to obtain the sufficient amount of the pushing force "F" of the movable plate 80, to overcome the above possible problem.

(3) Third Feature and Advantage:

According to the present embodiment, the first annular groove 25*m* is formed in the annular shape, which extends along the first contacting surfaces 25*a* and 25*b* and the first sealing surface 82*a*, while the second annular groove 26*m* is likewise formed in the annular shape, which extends along the second contacting surfaces 26*a* and 26*b* and the second sealing surface 82*b*.

According to such a structure, a length of the first and second annular grooves 25*m* and 26*m* can be made longer than that of a case, in which the first and second grooves 25*m* and 26*m* have other shapes than the annular shape. It is, therefore, possible to make areas of the respective spaces between the contacting surfaces 25*a*, 25*b*, 26*a* and 26*b* and the sealing surfaces 82*a* and 82*b* larger, into which the fuel flows from the grooves 25*m* and 26*m*. As a result, it is possible to facilitate the flow-in of the fuel into the spaces between the contacting surfaces and the sealing surfaces, to thereby further reduce the linking force.

(4) Fourth Feature and Advantage:

As explained below in connection with a fifth embodiment (FIG. 11) of the present disclosure, the first and second annular grooves 25*m* and 26*m* may be formed not at the lower end surface of the fixed plate 20 (the first embodiment) but at the upper end surface of the movable plate 80. In the fifth embodiment (FIG. 11), the first and second annular grooves are designated by 82*am* and 82*bm*. In such an embodiment, it is necessary to decide dimensions of related parts in order that the annular grooves 82*am* and 82*bm* may not be displaced from the lower end surfaces of the wall portions 25 and 26 even when the movable plate 80 is displaced in the radial direction of the fuel injection valve (that is, in the horizontal direction in the drawing of FIG. 11).

According to the present embodiment, however, the first and second annular grooves 25*m* and 26*m* are formed at the lower end surface of the fixed plate 20. Therefore, when compared with the above explained modification (corresponding to the fifth embodiment explained below), the present embodiment is more advantageous in that the first and second annular grooves 25*m* and 26*m* are not displaced from the sealing surfaces 82*a* and 82*b* formed on the upper end surface of the movable plate 80.

Second Embodiment

As explained above and shown in FIG. 6, in the first embodiment, the first communication groove 25*n* communicates the first annular groove 25*m* to the low pressure port 23*c*, while the second communication groove 26*n* communicates the second annular groove 26*m* to the annular recessed portion 24 in the plate-contacted condition. According to a second embodiment of the present disclosure, as shown in FIG. 8, the first communication groove 25*n* communicates the first annular groove 25*m* to the high pressure port 22*b*, and the second communication groove 26*n* also communicates the second annular groove 26*m* to the high pressure port 22*b*.

Figure 8:
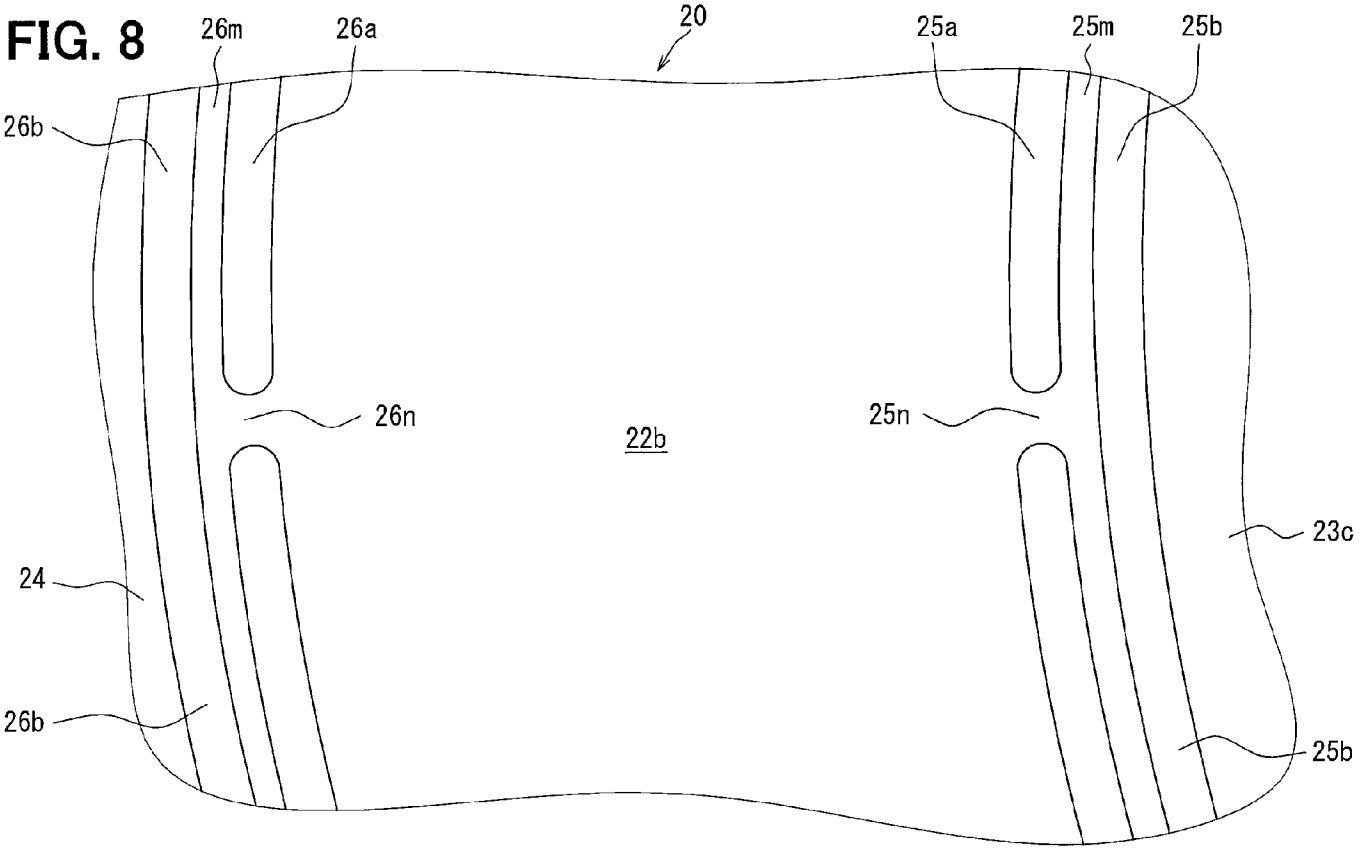
FIG. 8 is a schematically enlarged bottom view showing a relevant portion of a fixed plate according to a second embodiment of the present disclosure.

It is also possible to combine the first embodiment shown in FIG. 6 and the second embodiment shown in FIG. 8. For example, the first communication groove 25*n* communicates the first annular groove 25*m* to the low pressure port 23*c*, while the second communication groove 26*n* communicates the second annular groove 26*m* to the high pressure port 22*b*. Alternatively, the first communication groove 25*n* communicates the first annular groove 25*m* to the high pressure port 22*b*, while the second communication groove 26*n* communicates the second annular groove 26*m* to the annular recessed portion 24.

Third Embodiment

In the above first and second embodiments, the communication grooves 25*n* and 26*n* are respectively formed, so that neither the first contacting surface 25*b* at which the first communication groove 25*n* is formed nor the second contacting surface 26*b* at which the second communication groove 26*n* is formed brings out the sealing function.

Figure 9:
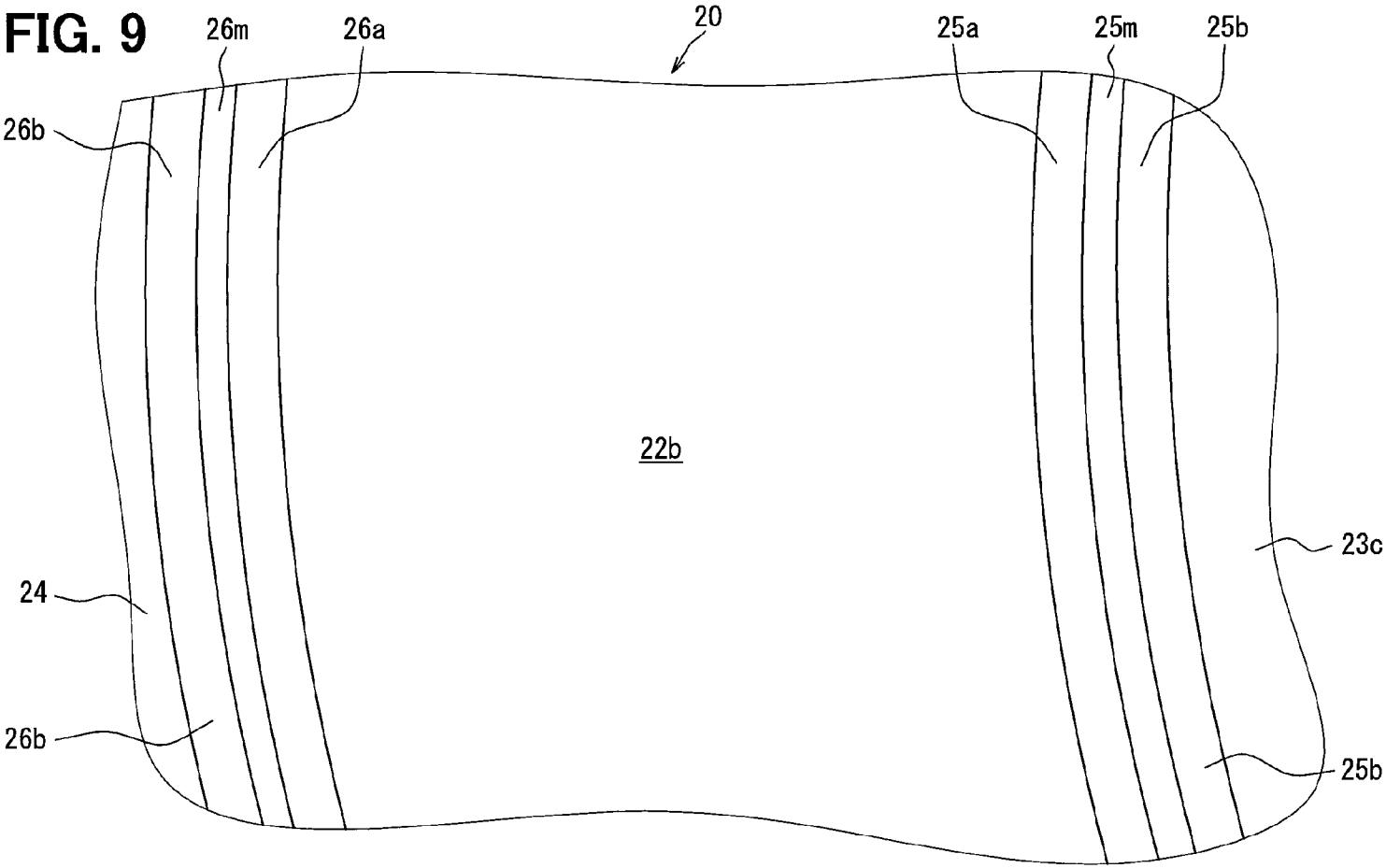
FIG. 9 is a schematically enlarged bottom view showing a relevant portion of a fixed plate according to a third embodiment of the present disclosure.

According to a third embodiment, however, as shown in FIG. 9, the communication grooves 25*n* and 26*n* are removed. As a result, each of the first contacting surfaces 25*a* and 25*b* as well as each of the second contacting surfaces 26*a* and 26*b* brings out the sealing function.

Fourth Embodiment

Figure 10:
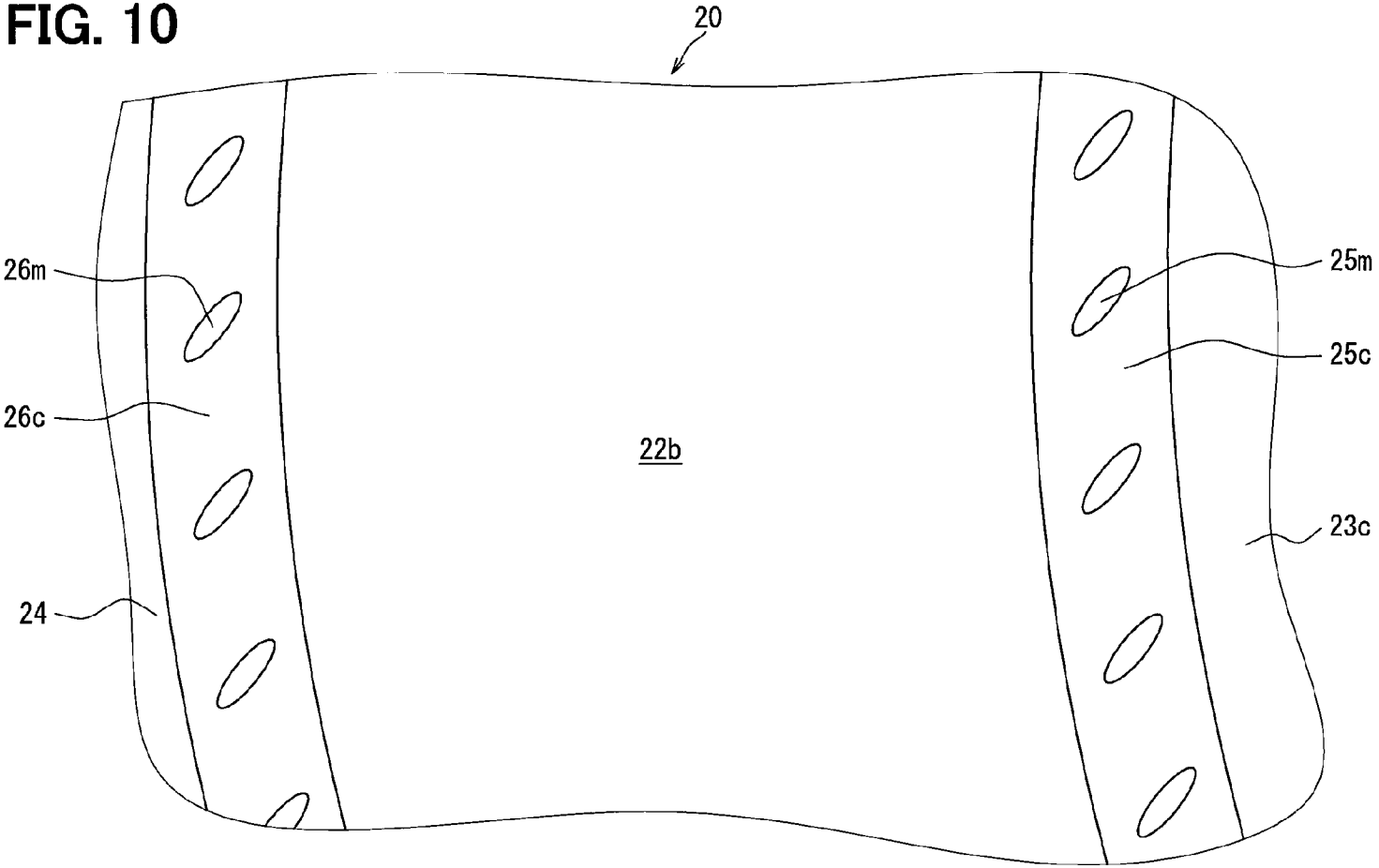
FIG. 10 is a schematically enlarged bottom view showing a relevant portion of a fixed plate according to a fourth embodiment of the present disclosure.

In the above embodiments, each of the grooves 25*m* and 26*m* is formed in the annular shape. According to a fourth embodiment, as shown in FIG. 10, multiple non-annular first grooves 25*m* are formed at a first contacting surface 25*c*, which is a lower end surface of the first wall portion 25. In a similar manner, multiple non-annular second grooves 26*m* are formed at a second contacting surface 26*c*, which is a lower end surface of the second wall portion 26. As in the same manner to the third embodiment, the communication grooves 25*n* and 26*n* are removed in the fourth embodiment.

Fifth Embodiment

Figure 11:
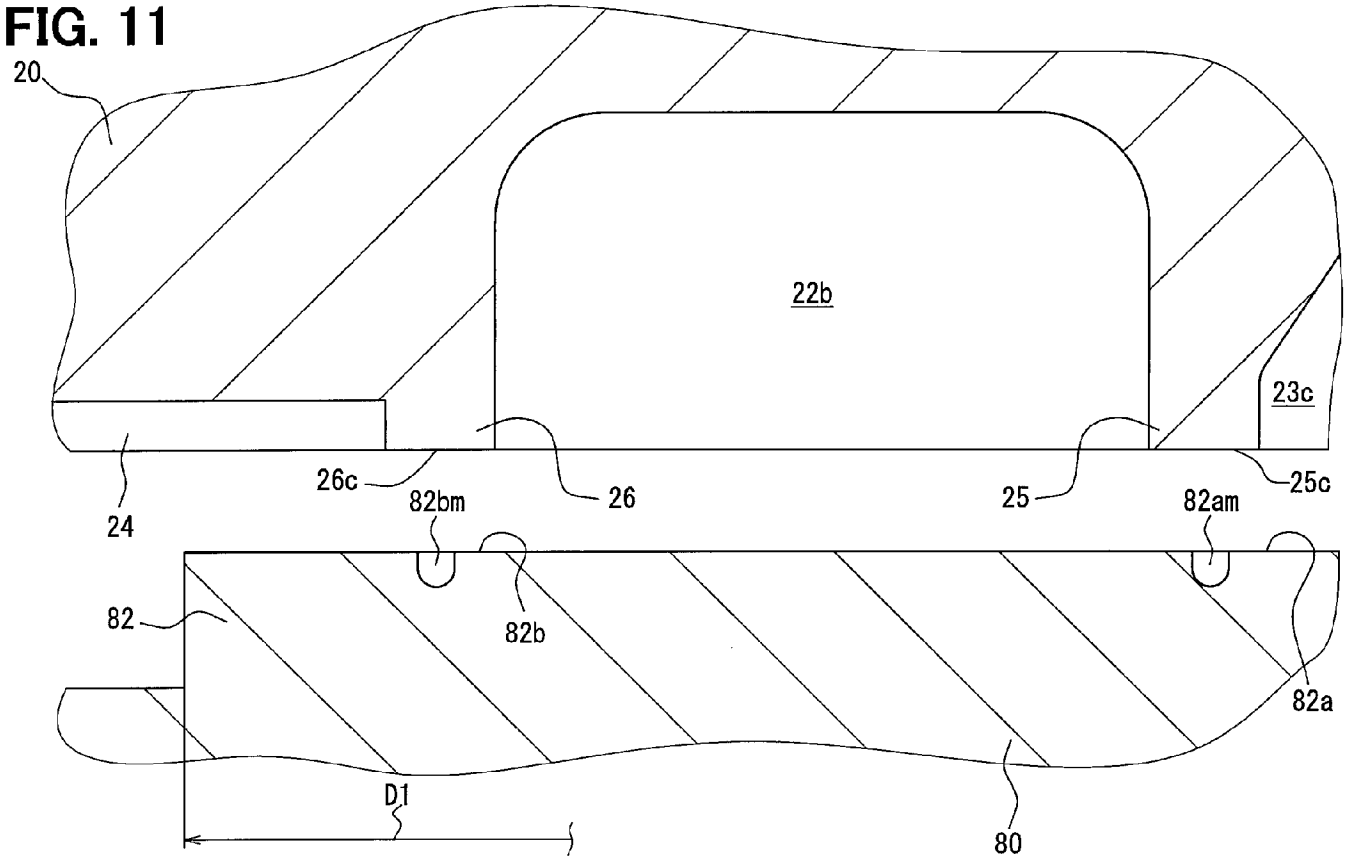
FIG. 11 is a schematically enlarged cross sectional view showing relevant portions of a fixed plate and a movable plate according to a fifth embodiment of the present disclosure.
Figure 12:
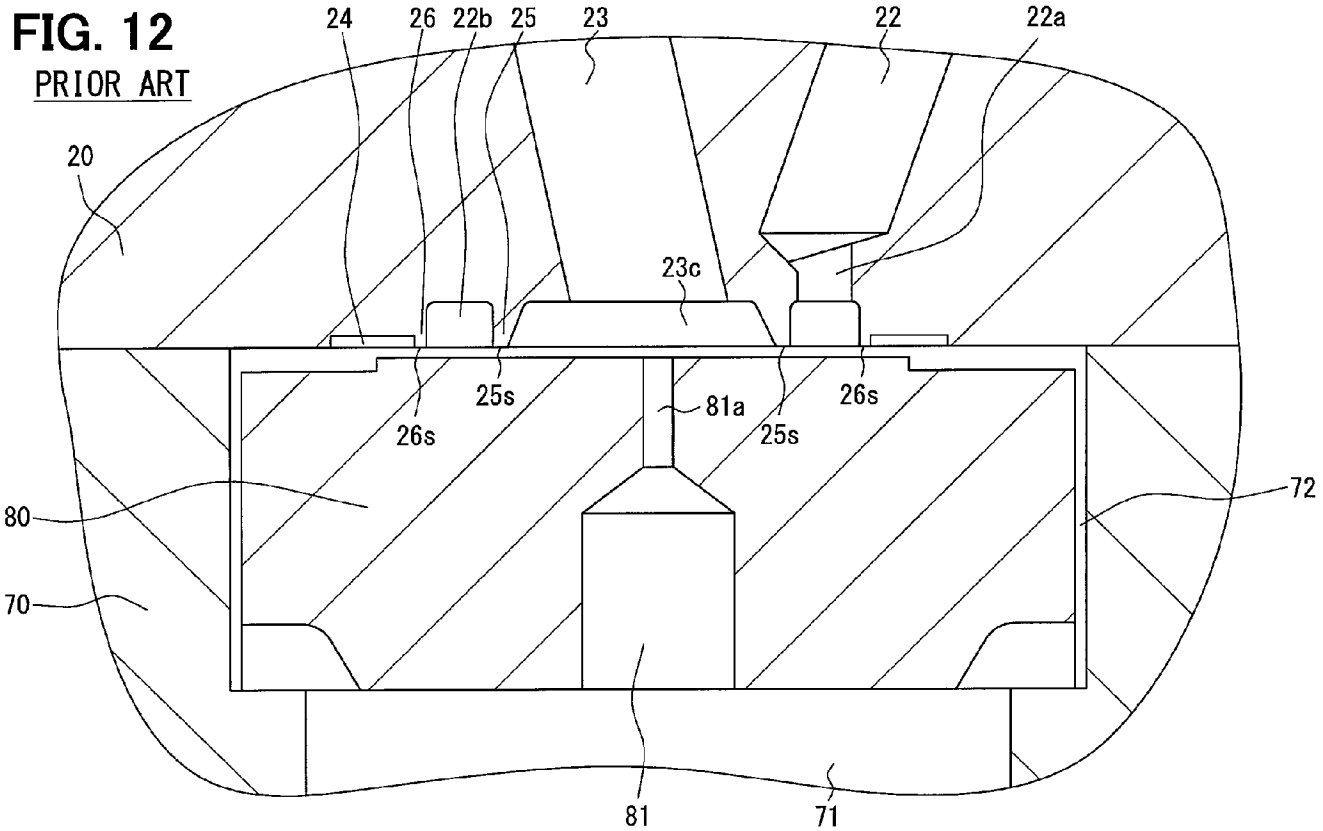
FIG. 12 PRIOR ART
FIG. 12 is a schematically enlarged cross sectional view showing relevant portions of a fixed plate and a movable plate according to a prior art fuel injection valve.

In the above embodiments, the first annular or non-annular groove(s) 25*m* and the second annular or non-annular groove(s) 26*m* are formed at the lower end surfaces of the fixed plate 20. According to a fifth embodiment, as shown in FIG. 11, a first annular groove 82*am* and a second annular groove 82*bm* are formed at the upper end surface of the movable plate 80.

More in detail, a portion of the upper end surface of the movable plate 80, which is opposed to the lower end surface 25*c* (the first contacting surface) of the first wall portion 25, corresponds to the first sealing surface 82*a*. The first annular grove 82*am* is formed at the first sealing surface 82*a*. In a similar manner, a portion of the upper end surface of the movable plate 80, which is opposed to the lower end surface 26*c* (the second contacting surface) of the second wall portion 26, corresponds to the second sealing surface 82*b*. The second annular groove 82*bm* is formed at the second sealing surface 82*b*.

Further Embodiments and/or Modifications

The present disclosure should not be limited to the above embodiments but can be modified in various manners as below. In addition, the features of the respective embodiments can be optionally combined with one another.

(M1) In the above embodiments, the second wall portion 26 is formed at the lower end surface of the fixed plate 20 so as to separate the high pressure port 22*b* and the annular recessed portion 24 from each other in the plate-contacted condition. However, the second wall portion 26 may be removed. In other words, the second contacting surfaces 26*a*, 26*b* or 26*c* and the second sealing surface 82*b* can be removed. Alternatively, in a modification in which the second contacting surfaces and the second sealing surface are formed, the second groove(s) 26*m* and 82*bm* may be removed.

(M2) In the fourth embodiment (FIG. 10), the multiple non-annular grooves 25*m* and 26*m* are formed at the respective contacting surfaces 25*c* and 26*c*. It may be so modified that a part of an area for the lower end surfaces of the first and second wall portions 25 and 26 is made as a rough surface during a surface-finish process. And such rough surface portions may be used as the grooves 25*m* and 26*m*.

(M3) In the first to third embodiments, one annular groove 25*m* or 26*m* is formed at each of the first and second wall portions 25 and 26. Multiple annular grooves may be formed at the lower end surface(s) of the first and/or the second wall portions.

(M4) In the above embodiments, the displacement of the movable plate 80 in the vertical direction (upward and downward direction) depends on the balance among the forces "F1", "F2", "F3" and "F4" produced by the fuel pressure. A spring may be provided in order to apply a spring force to the movable plate 80. For example, the spring force may be applied to the movable plate 80 in a direction toward the fixed plate 20.

What is claimed is:

1. A fuel injection valve comprising:

a valve body movably accommodated in a nozzle body for opening or closing an injection port;

a pressure control chamber for applying fuel pressure to the valve body in a valve-body closing direction;

a fixed plate having a high pressure passage for supplying high pressure fuel to the pressure control chamber so as to move the valve body in the valve-body closing direction, the fixed plate having a low pressure passage for discharging fuel out of the pressure control chamber so as to move the valve body in a valve-body opening direction, and the fixed plate having a lower end surface at which a high pressure port connected to the high pressure passage and a low pressure port connected to the low pressure passage are formed; and a movable plate movably accommodated in the pressure control chamber, the movable plate being brought into contact with the lower end surface of the fixed plate when the fuel is discharged from the pressure control chamber so as to close the high pressure port, and the movable plate being separated from the lower end surface of the fixed plate when the high pressure fuel is supplied to the pressure control chamber so as to open the high pressure port, wherein the lower end surface has a first contacting surface for separating the high pressure port from the low pressure port in a plate-contacted condition in which the movable plate is in contact with the fixed plate, wherein the movable plate has a first sealing surface for sealing a space between the first contacting surface and the first sealing surface in the plate-contacted condition, and wherein a first groove is formed at the first contacting surface and/or the first sealing surface for holding a part of fuel when the movable plate is brought into contact with the fixed plate.

2. The fuel injection valve according to claim 1, wherein a first communication groove is formed at the first contacting surface or the first sealing surface for communicating the first groove to the high pressure port or the low pressure port in the plate-contacted condition.

3. The fuel injection valve according to claim 2, wherein the first communication groove communicates the first groove to the low pressure port in the plate-contacted condition.

4. The fuel injection valve according to claim 1, wherein the high pressure port is formed in an annular shape so as to surround the low pressure port, each of the first contacting surface and the first sealing surface is formed in an annular shape between the high pressure port and the low pressure port, and the first groove is formed in an annular shape and extends along the first contacting surface and the first sealing surface.

5. The fuel injection valve according to claim 1, wherein the first groove is formed at the first contacting surface.

6. The fuel injection valve according to claim 1, wherein a recessed portion is formed in the lower end surface of the fixed plate on a side of the high pressure port opposite to the low pressure port, the lower end surface has a second contacting surface for separating the high pressure port from the recessed portion in the plate-contacted condition, the movable plate has a second sealing surface for sealing a space between the second contacting surface and the second sealing surface in the plate-contacted condition, and a second groove is formed at the second contacting surface and/or the second sealing surface for holding a part of fuel when the movable plate is brought into contact with the fixed plate.

7. The fuel injection valve according to claim 6, wherein a second communication groove is formed at the second contacting surface or the second sealing surface for communicating the second groove to the high pressure port or the recessed portion in the plate-contacted condition.

8. The fuel injection valve according to claim 7, wherein the second communication groove communicates the second groove to the recessed portion in the plate-contacted condition.

9. The fuel injection valve according to claim 6, wherein the high pressure port is formed in an annular shape so as to surround the low pressure port, the recessed portion is formed in an annular shape so as to surround the high pressure port, each of the second contacting surface and the second sealing surface is formed in an annular shape between the high pressure port and the recessed portion, and the second groove is formed in an annular shape and extends along the second contacting surface and the second sealing surface.

10. The fuel injection valve according to claim 6, wherein the second groove is formed at the second contacting surface.

* * * * *